US009607797B2

(12) United States Patent
Najera et al.

(10) Patent No.: US 9,607,797 B2
(45) Date of Patent: Mar. 28, 2017

(54) LOW MOVEMENT TRIP AND INTEGRATED SIGNAL FLAG FOR MINIATURE CIRCUIT BREAKERS

(71) Applicant: SCHNEIDER ELECTRIC USA, INC., Palatine, IL (US)

(72) Inventors: Gerardo Rodriguez Najera, Nuevo Leon (MX); Daniel Reynoso Ortiz, Nuevo Leon (MX); Juan Ignacio Melecio Ramirez, Celaya (MX); Efrain Gutierrez Villanueva, Ciudad Guadalupe (MX); Vicente Noguez Salazar, San Nicolas de los Garza (MX)

(73) Assignee: Schneider Electric USA, Inc., Andover, MA (US)

( * ) Notice: Subject to any disclaimer, the term of this patent is extended or adjusted under 35 U.S.C. 154(b) by 51 days.

(21) Appl. No.: 14/321,787

(22) Filed: Jul. 1, 2014

(65) Prior Publication Data

US 2016/0005555 A1 Jan. 7, 2016

(51) Int. Cl.

| | |
|---|---|
| ***H01H 9/20*** | (2006.01) |
| ***H01H 71/04*** | (2006.01) |
| ***H01H 71/24*** | (2006.01) |

(52) U.S. Cl.

CPC ..... *H01H 71/04* (2013.01); *H01H 71/2454* (2013.01); *H01H 71/2472* (2013.01)

(58) Field of Classification Search

CPC ..... H01H 9/20; H01H 75/10; H01H 9/16

See application file for complete search history.

(56) References Cited

U.S. PATENT DOCUMENTS

| | | | | |
|---|---|---|---|---|
| 4,037,185 | A * | 7/1977 | Klein | 335/18 |
| 4,969,063 | A | 11/1990 | Scott et al. | |
| 5,302,787 | A | 4/1994 | Edds et al. | |
| 6,803,535 | B1 | 10/2004 | Whipple et al. | |
| 2002/0158725 | A1* | 10/2002 | Nerstrom et al. | 335/17 |
| 2007/0200652 | A1 | 8/2007 | Gibson et al. | |
| 2013/0271257 | A1* | 10/2013 | Yang | 337/37 |

* cited by examiner

*Primary Examiner* — Bernard Rojas
(74) *Attorney, Agent, or Firm* — Locke Lord LLP

(57) ABSTRACT

A circuit breaker includes a trip mechanism having reduced trip movement and an integrated signal flag. The trip mechanism includes a spring-biased trip lever and a latching member for keeping the trip lever in an on or latched position. Upon occurrence of an abnormal current condition, the latching member is moved away from the trip lever to trip the trip mechanism. The latching member also has a catch mechanism designed to catch the trip lever after it is released, thereby halting further progress of both the trip lever and the latching member. As a result, less space is needed within the circuit breaker for trip movement compared to existing solutions. Moreover, the location of the catch mechanism on the latching member is selected such that the halting of the latching member places the integrated signal flag in an optimal viewing position within a viewing window.

8 Claims, 4 Drawing Sheets

LOW MOVEMENT TRIP AND INTEGRATED SIGNAL FLAG FOR MINIATURE CIRCUIT BREAKERS

FIELD OF THE INVENTION

The disclosed embodiments relate generally to miniature circuit breakers and more particularly to miniature circuit breakers having reduced trip movement and integrated signal flag.

BACKGROUND OF THE INVENTION

Circuit breakers provide automatic power interruption to an electrical load when abnormal current conditions occur, such as an overload current or a short circuit. A circuit breaker is typically deployed on a line conductor between a load and a power source. The power source provides current over the line conductor through the circuit breaker and to the load, which is typically also connected to ground. A neutral conductor may provide a return path from the load through the circuit breaker and back to the power source.

A typical circuit breaker has a load terminal for connecting the circuit breaker to the load and a line terminal for connecting the circuit breaker to the line conductor. A braided wire conductor carries current from the line terminal to one side of a trip mechanism, the other side of the trip mechanism being connected to the load terminal by electrical contact to form a path for current to flow through the circuit breaker. When an abnormal current condition is detected, the trip mechanism automatically breaks the electrical contact with the load terminal to interrupt the flow of current.

In most circuit breakers, the trip mechanism uses a spring-biased trip lever to break the electrical contact with the load terminal. This trip lever is generally U-shaped and is retained in a latched position by an armature. The armature has a central opening within which the tip of the trip lever is seated. As long as the trip lever remains engaged to the armature, current is allowed to flow. When an abnormal current condition occurs, the armature is moved in a direction away from the trip lever such that the tip of the trip lever becomes disengaged from the armature. This releases the trip lever and breaks the electrical contact with the load terminal.

Moving the armature away from the trip lever is typically accomplished using a yoke to which the armature is connected. In electromechanical yokes, a bimetal strip bends in response to an overcurrent flowing through the bimetal strip. This bending of the bimetal strip distorts the yoke and forces the armature away from the trip lever. An electromagnetic yoke, on the other hand, has the braided wire conductor wrapped as a coil wound around the yoke. When a short-circuit current flows through the braided wire conductor, the yoke becomes highly magnetized and pulls the armature away from the trip lever. Many circuit breakers provide protection from both overcurrent and short-circuit current, which is typically much higher and can render the circuit breakers unfit for further use.

In most circuit breakers, the armature only needs to travel a small distance for the tip of the trip lever to come out of the central opening. Similarly, the trip lever only needs to travel only a small distance to break the electrical contact with the load terminal. Nevertheless, these circuit breakers allow the armature and the trip lever both to travel freely until they are otherwise stopped by other components in the circuit breakers. This requires extra space to be allocated within the circuit breaker to accommodate the excess movement. Such allocation of extra space is wasteful and inefficient, especially in miniature circuit breaker ("MCB") where the goal is to reduce the size of the circuit breaker as much as possible.

In addition, due to their small size, many MCBs include a trip flag that helps visually to indicate when the device has been tripped. The trip flag is typically painted in an appropriate emergency color, such as orange or red, and is "pinned" or otherwise attached to the trip lever. When the circuit breaker is tripped, the movement of the trip lever also moves the trip flag into a viewing window in the outer casing of the circuit breaker to provide a visual indication the circuit breaker has been tripped. Existing miniature circuit breakers, however, use a trip flag that is a separate and discrete component. This increases the component count of the circuit breaker and complicates its assembly.

Accordingly, a need exists for an improved trip mechanism for a circuit breaker, and particularly a trip mechanism that allows the circuit breaker to be miniaturized as much as possible while also reducing the component count and assembly complexity of the circuit breaker.

SUMMARY OF THE DISCLOSED EMBODIMENTS

The disclosed embodiments address the above and other shortcomings of existing circuit breakers by providing a trip mechanism that has reduced trip movement and an integrated signal flag. The disclosed trip mechanism includes a trip lever and a latching member designed to retain the trip lever in a latched position. The latching member has a main body and a central opening formed therein where the tip of the trip lever is seated when the trip lever is in a latched position. The latching member further preferably carries the integrated signal flag. Upon occurrence of an abnormal current condition, the latching member is moved away from the trip lever, which releases the trip lever and allows it to transition to an unlatched or tripped position. The latching member also has a catch mechanism designed to catch the tip of the trip lever as it swings through its arcuate path or curve upon becoming unlatched. Catching the trip lever in the catch mechanism halts and prevents further progress of both the trip lever and the latching member. As a result, less space is needed within the circuit breaker to accommodate trip movement compared to existing solutions. In addition, the location of the catch mechanism on the latching member is selected such that the halting of the latching member places the integrated signal flag in an optimal viewing position within a viewing window through the case of the circuit breaker. Such an arrangement reduces the individual component count of the circuit breaker and also simplifies the assembly of the circuit breaker.

In some embodiments, the latching member may be a yoke having a main body and two sides bent at roughly right angles to the main body to give the yoke the appearance of a U-shaped channel. In these embodiments, the catch mechanism may be a retention slot formed in the main body at a predefined distance from the central opening. An electromagnetic armature is provided that becomes magnetized in response to a short-circuit current to pull the yoke away from the trip lever. As well, a thermal trip actuator may be attached to such a yoke to pull the yoke away from the trip lever when an overcurrent is present. A hook extends from the bottom of the main body and allows the yoke to be hingedly mounted about a pin so that it can rotate toward the armature. The rotation of the yoke toward the armature releases the trip lever. The trip lever is subsequently caught by the retention slot on the yoke, thus limiting the movement of both the trip lever and the yoke.

In some embodiments, the yoke may include a signal flag that helps visually to indicate when the circuit breaker has been tripped. The signal flag may be painted an appropriate emergency color, such as orange or red, and may be integrally formed with the yoke. When the circuit breaker is tripped, the movement of the yoke moves the trip flag into a viewing window in the outer casing of the circuit breaker to provide a visual indication the circuit breaker has been tripped. In some embodiments, the signal flag may be located at a particular location on the yoke, and may be oriented in a particular orientation, such that the signal flag is optimally positioned for viewing within the viewing window when the rotation of the yoke toward the armature is halted by the retention slot catching the trip lever.

In general, in one aspect, the disclosed embodiments are directed to a latching member for a trip mechanism of a circuit breaker a main body. The latching member comprises, among other things, a central opening formed in the main body, the central opening configured to engage a tip portion of a trip lever of the trip mechanism, and a catch mechanism formed in the main body a predefined distance from the central opening. The catch mechanism is configured to catch the tip portion of the trip lever of the trip mechanism.

In general, in another aspect, the disclosed embodiments are directed to a trip mechanism of a circuit breaker. The trip mechanism comprises, among other things, a trip lever rotatably mounted in the circuit breaker and configured to transition from an on position to a tripped position, and a latching member movably mounted in the circuit breaker and configured to releasably hold the trip lever in the latched position. The trip mechanism further comprises an armature disposed in the circuit breaker adjacent to the latching member, the armature configured to compel the latching member away from the trip lever, thereby causing the trip lever to transition from the latched position to the unlatched position, when a short-circuit condition occurs. The latching member is further configured to catch the trip lever during the transition from the on position to the tripped position, and catching the trip lever halts further progress of the latching member within the circuit breaker.

In general, in still another aspect, the disclosed embodiments are directed to a miniature circuit breaker. The miniature circuit breaker comprises, among other things, a line terminal, a trip mechanism connected to the line terminal. The trip mechanism includes a trip lever rotatably mounted in the miniature circuit breaker, a yoke pivotably mounted in the miniature circuit breaker the yoke having a catch mechanism formed therein that stops the progress of both the yoke and the trip lever as the trip lever is transitioning from an ON position to a tripped position, a signal flag attached to the yoke, an armature disposed proximate to the yoke, and a thermal trip actuator attached to the yoke. The miniature circuit breaker devices further comprises a load terminal connected to the trip mechanism, wherein the trip mechanism is configured to allow current flow from the line terminal to the load terminal under normal conditions and to break current flow from the line terminal to the load terminal under abnormal current conditions.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

As well, it should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1A:
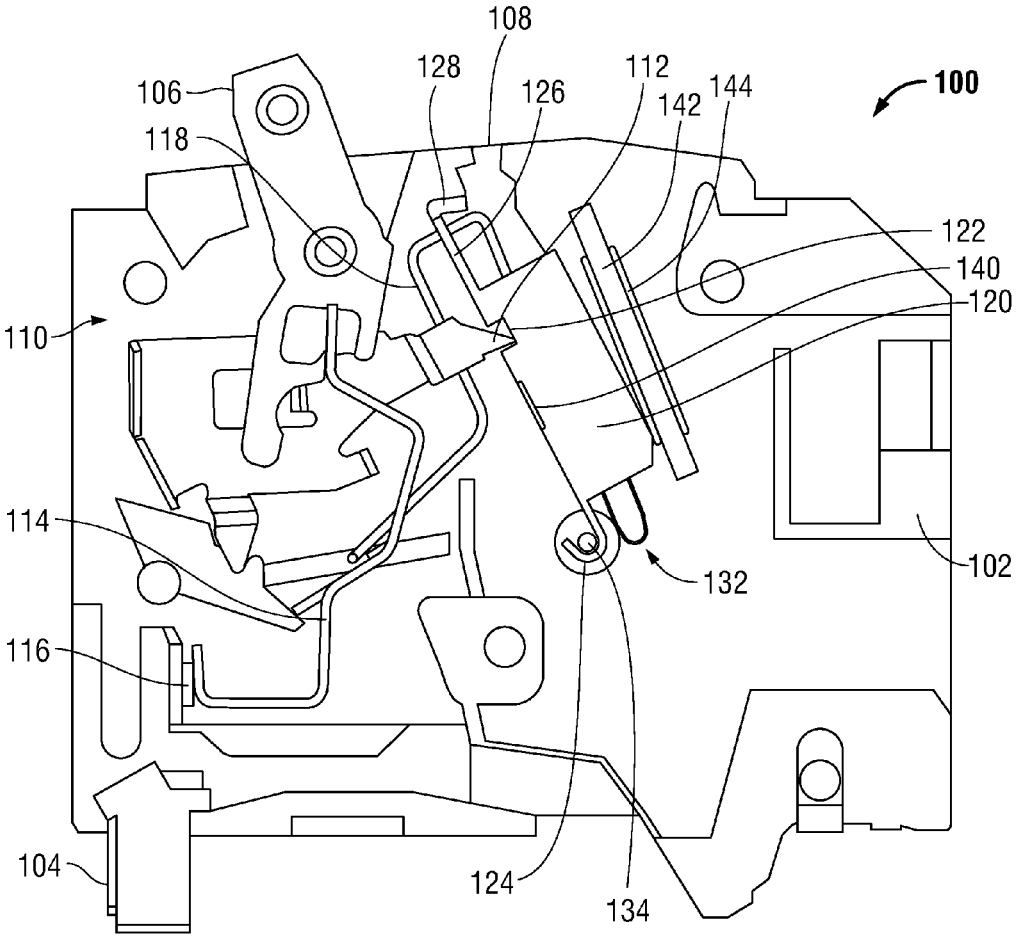
FIGS. 1A and 1B show internal views of an exemplary circuit breaker having a trip mechanism according to some implementations of the disclosed embodiments.
Figure 1B:
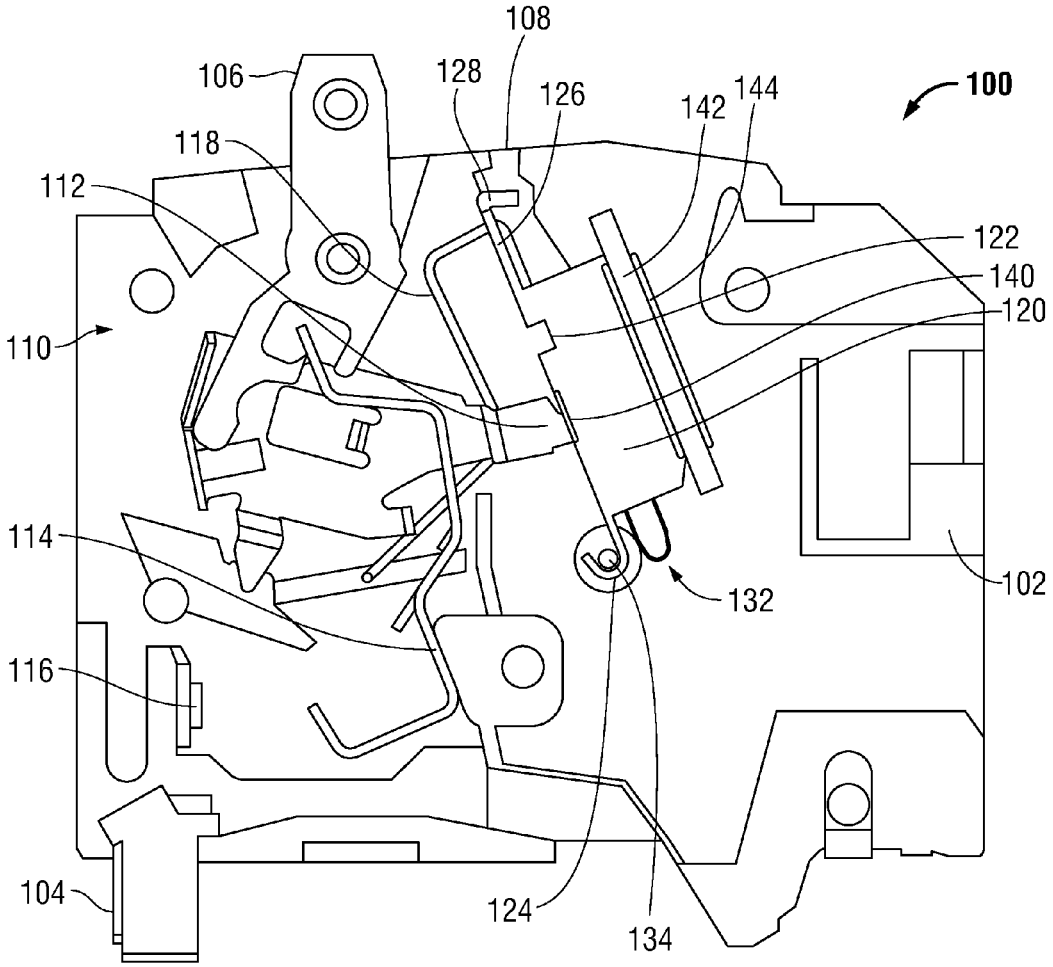

Referring now to FIGS. 1A and 1B, several views of a circuit breaker 100 according to the disclosed embodiments are shown with the outer casing of the circuit breaker 100 open. As is typical, the circuit breaker 100 includes a load side connector 102, a power line connector 104, and a handle 106. The handle 106 allows the circuit breaker 100 to be switched between an OFF state to an ON state (see FIG. 1A) and also placed in a tripped state (see FIG. 1B). In some embodiments, a viewing window 108 on the outer casing of the circuit breaker 100 allows a visual indication of whether the circuit breaker is in the tripped stated.

The handle 106 engages a trip mechanism 110 and may be used to set the trip mechanism 110 and thus the circuit breaker 100 according to one of the states mentioned above. The trip mechanism 110 may include, among other things, a trip lever 112, a rotating contact arm 114 connected to the trip lever 112, and a stationary electrical contact 116 for the power line connector 104. When in contact with the electrical contact 116, the rotating contact arm 114 also makes contact with a braided wire conductor 118 to provide an electrical path between the power line connector 104 and the load side connector 102. A spring (not expressly shown) is coupled between the rotating contact arm 114 and the trip lever 112 in a manner well known to those having ordinary skill in the art. The spring serves to drive the trip lever 112 and hence the handle 106 to the tripped position (see FIG. 1B) upon occurrence of an abnormal current flow condition. The trip lever 112 is rotatably mounted such that it can swing in an arcuate path upon becoming unlatched, as previously explained. The movement of the trip lever 112 when unlatched pulls the contact arm 114 away from the stationary electrical contact 116, thus breaking the electrical path between the power line connector 104 and the load side connector 102.

The trip mechanism 110 further includes a latching member 120 configured to engage and retain the trip lever 112 in a latched position under normal current flow conditions. This latching member 120 has a central opening 122 formed therein designed to receive and hold the end or tip of the trip lever 112. Any suitable form or shape may be used for the latching member 120, including a yoke having a shape substantially in the form of a U-shaped channel, as later described herein. A hook 124 extends from the bottom of the latching member 120 along the length thereof and engages a pin 134 protruding from the casing of the circuit breaker 100. The hook 124 allows the latching member 120 to pivot or rotate about the pin 134 during a trip event.

For embodiments that include a viewing window 108, a flag arm 126 may be provided extending from the top of the latching member 120 along the length thereof that terminates in a signal flag 128. To reduce the component count, the flag arm 126 and the signal flag 128 may be formed as an integral part of the latching member 120, although it is certainly possible for the flag arm 126 and the signal flag 128 to be implemented as separate components from the latching member 120. The signal flag 128 may be painted an appropriate emergency color, for example, orange or red, and may also be bent at a predefined angle relative to the flag arm 126, such as a right angle, so it may be more easily seen in the viewing window 108 when the circuit breaker 100 has been tripped. A spring (not expressly shown) may be provided to bias the latching member 120 toward the trip lever 112.

In some embodiments, a thermal trip actuator 132, only a portion of which is visible here, may be attached to the latching member 120 for moving the latching member 120 away from the trip lever 112. The thermal trip actuator 132 may be connected to the braided wire conductor 118 (the connection is not visible here) and may be designed to deform in the presence of an overcurrent flowing through the braided wire conductor 118. The deformation of the thermal trip actuator 132 operates to pull the latching member 120 away from the trip lever 112 when there is an overcurrent in the braided wire conductor. Any suitable thermal actuator may be used for the thermal trip actuator 132, including a traditional bi-metal actuator that relies on deformation resulting from the difference in thermal expansion between two different materials to move the latching member 120 away from the trip lever 112.

In accordance with the disclosed embodiments, the latching member 120 may include a catch mechanism 140 for catching the trip lever 112 after it has been released from the central opening 122. The catch mechanism 140 may be located on the latching member 120 a predefined distance from the central opening 122 along the arcuate swing of the trip lever 112. The exact distance between the central opening 122 and the catch mechanism 140 may be selected as needed for a given application, but in preferred embodiments, this distance is long enough to allow the trip lever 112 to move sufficiently to trip the circuit breaker 100, but not long enough for the trip lever 112 to complete its full swing.

The catch mechanism 140 thereafter catches the trip lever 112 and halts any further progress of the trip lever 112, which also stops any further progress of the latching member 120. The premature or preemptive halting of the trip lever 112 and the latching member 120 results in less space being required within the circuit breaker 100 to accommodate trip movement compared to existing solutions. This can be seen in FIG. 1B, where the movement of the trip lever 112 has been stopped by the catch mechanism 140 after the contact between the rotating contact arm 114 and the electrical contact 116 has been broken. In addition, the location of the catch mechanism 140 on the latching member 120 may be selected so that the stopping of the latching member 120 also places the integrated signal flag 128 in an optimal viewing position within the viewing window 108. To help ensure optimal viewing, the signal flag 128 may also be oriented at a predefined angle relative to the flag arm 126 that provides maximum visibility when the signal flag 120 is positioned within the viewing window 108.

In some embodiments, while the thermal trip actuator 132 is designed to offer adequate "long period" overcurrent protection, additional magnetic measures may be included for protection against the rapid rise of short-circuit current. In these embodiments, the trip mechanism 110 may further include an armature 142 fixedly mounted adjacent to the latching member 120. The armature 142 may be an electromagnetic armature in that the braided wire conductor 118 may be wrapped as a coil 144 wound around the armature 142. Then, when a short-circuit current flows through the wound coil 144, the armature 142 becomes highly magnetized and pulls the latching member 120 away from the trip lever 112. As a result, the trip lever 112 becomes unlatched and begins to swing through its arcuate path. The trip lever 112 is then stopped by the catch mechanism 140 of the latching member 120 before it can complete its swing, which also stops any further movement of the latching member 120 toward the armature 142.

Figure 2A:
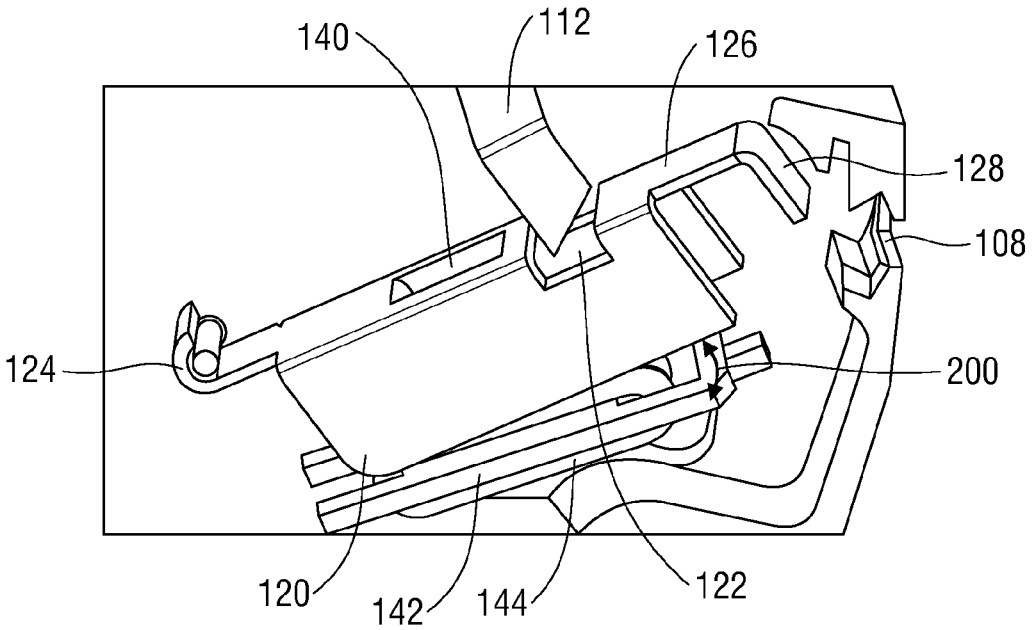
FIGS. 2A and 2B are close-up views of an exemplary trip mechanism according to some implementations of the disclosed embodiments.
Figure 2B:
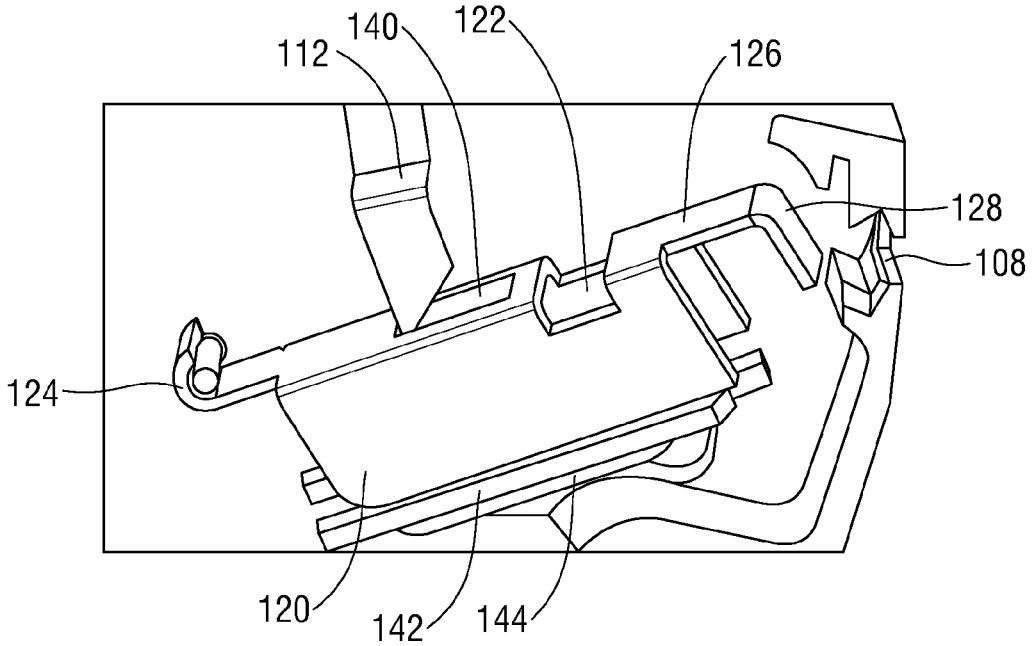

FIGS. 2A and 2B show close-up views of a portion of the trip mechanism 110 according to the exemplary disclosed embodiments. As can be seen in FIG. 2A, the trip lever 112 is latched within the central opening 122 of the latching member 120 and the integrated trip flag 128 is outside the viewing window 108. Upon occurrence of an abnormal current condition, which may result from either an overcurrent or a short-circuit current, the trip lever 112 is released from the central opening 122, and is subsequently caught by the catch mechanism 140. This is depicted in FIG. 2B, where the swing of the trip lever 112 has been prematurely halted by the catch mechanism 140, which also stops the progress of the latching member 120 toward the armature 142. In some embodiments, the latching member 120 only moves an angular distance of approximately 9 to 10 degrees (within ±10 percent) toward the armature 142, as indicated by the arrow 200 in FIG. 2A, before the movement is stopped by the catch mechanism 140. Preferably, this angular distance places the integrated signal flag 128 in an optimal viewing position within the viewing window 108. Other angular distances may of course be used as needed by the particular requirements of a specific application.

Figure 3A:
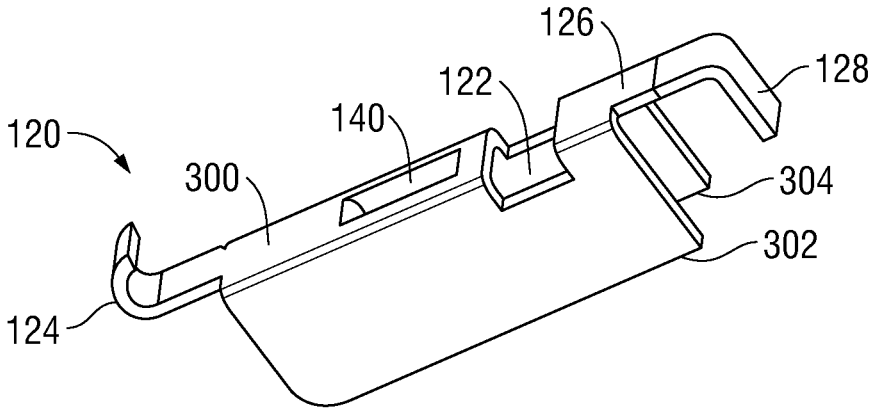
FIGS. 3A and 3B show examples of exemplary yokes according to some implementations of the disclosed embodiments.
Figure 3B:
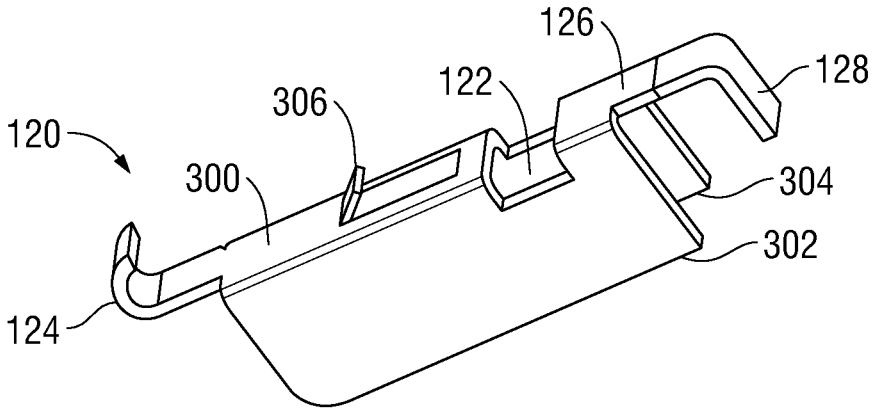

FIGS. 3A and 3B are perspective views of the latching member 120 according to the exemplary disclosed embodiments. As for the latching member 120, as mentioned earlier, the latching member 120 may take any form or shape suitable for a given application. In the embodiments shown here, the latching member 120 is a yoke having a main body 300 and two sides 302 and 304 bent or folded at roughly right angles to the main body 300 to give the yoke 120 the appearance of a U-shaped channel. In these embodiments, the integrated flag arm 126 and the signal flag 128 may extend from the top end of the U-shaped channel and the hook 124 may extend from the bottom end of the U-shaped channel, while the catch mechanism 140 may be a retention slot formed in the main body at a predefined distance from the central opening 122. The retention slot 140 may be formed by punching or otherwise partially cutting a section of the main body 300 through or from the main body 300 in the direction of the two sides 302 and 304, as illustrated in FIG. 3A. Other ways of forming the retention slot 140 may of course be used without departing from the scope of the disclosed embodiments.

In an alternative embodiment, as illustrated in FIG. 3B, the catch mechanism may be in the form of a protrusion 306 extending from the main body 300 a predefined distance from the central opening 122. Such a protrusion 306 may be formed, for example, by punching or otherwise partially cutting a section or tab out of the main body 300 in a direction away from the main body 300. The section or tab may then be trimmed to form the protrusion 306 so that a hole 308 is formed in the area previously occupied by the section or tab. Other techniques for forming the protrusion 306 may certainly be used without departing from the scope of the disclosed embodiments.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the disclosed embodiments as defined in the appended claims.

What is claimed is:

1. A trip mechanism of a circuit breaker, comprising:

a trip lever rotatably mounted in the circuit breaker and configured to transition from an on position to a tripped position;

a latching member movably mounted in the circuit breaker and configured to releasably hold the trip lever in the latched position; and an armature disposed in the circuit breaker adjacent to the latching member, the armature configured to compel the latching member away from the trip lever, thereby causing the trip lever to transition from the latched position to the unlatched position, when a short-circuit condition occurs;

wherein the latching member is further configured to catch the trip lever during the transition from the on position to the tripped position, and catching the trip lever halts further progress of the latching member within the circuit breaker;

wherein the latching member has a signal flag integrally formed therewith for providing a visual indication that the circuit breaker has been tripped; and wherein the latching member is a yoke having a form of a U shape and the signal flag extends from a top portion of the yoke.

2. The trip mechanism of claim 1, wherein the armature is an electromagnetic armature configured to become magnetized when an abnormal current condition occurs.

3. The trip mechanism of claim 1, further comprising a thermal trip actuator attached to the latching member, the thermal trip actuator configured to deform when heated, thereby moving the latching member away from the trip lever when an overcurrent condition occurs.

4. The trip mechanism of claim 1, wherein catching the trip lever also halts further progress of the trip lever within the circuit breaker.

5. The trip mechanism of claim 1, wherein the latching member is pivotably mounted in the circuit breaker so as to be rotatable toward the armature.

6. The trip mechanism of claim 1, wherein the yoke has a hook extending from a bottom portion of the yoke.

7. The trip mechanism of claim 1, wherein the latching member catches the trip lever in a retaining slot formed in the latching member.

8. The trip mechanism of claim 1, wherein the latching member catches the trip lever on a protrusion formed on the latching member.

* * * * *